US006564938B1

(12) United States Patent
Thompson

(10) Patent No.: US 6,564,938 B1
(45) Date of Patent: May 20, 2003

(54) PACKAGING PARTICULARLY USEFUL FOR HEAVY, CUMBERSOME OBJECTS

(75) Inventor: Ronald W. Thompson, Barrington, IL (US)

(73) Assignee: Cougar Package Designers, Inc., West Chicago, IL (US)

( * ) Notice: Subject to any disclaimer, the term of this patent is extended or adjusted under 35 U.S.C. 154(b) by 0 days.

(21) Appl. No.: 09/533,534

(22) Filed: Mar. 23, 2000

Related U.S. Application Data

(60) Provisional application No. 60/125,863, filed on Mar. 24, 1999.

(51) Int. Cl.[7] ..... B65D 81/133

(52) U.S. Cl. ..... 206/320; 206/586; 428/118

(58) Field of Search ..... 206/320, 453, 206/576, 521, 586, 321; 428/116, 118; 493/463

(56) References Cited

U.S. PATENT DOCUMENTS 2,960,217 A * 11/1960 Nason ..... 206/320
3,003,622 A * 10/1961 Hardigg ..... 206/521
3,179,023 A * 4/1965 Hoff ..... 493/463
3,757,935 A * 9/1973 Coons et al. ..... 206/320
3,773,171 A * 11/1973 Edsall ..... 206/320
3,982,057 A * 9/1976 Briggs et al. ..... 206/521
4,709,817 A * 12/1987 Keady et al. ..... 206/521
5,040,696 A * 8/1991 Liebel ..... 206/521
5,175,041 A * 12/1992 Webb et al. ..... 206/586
5,511,667 A * 4/1996 Carder ..... 206/586
5,540,972 A * 7/1996 Jaegers et al. ..... 428/116
5,680,934 A * 10/1997 Jaegers et al. ..... 206/586
5,683,781 A * 11/1997 Komarek et al. ..... 428/116
5,867,853 A * 2/1999 Feld ..... 5/663
5,950,835 A * 9/1999 Moser et al. ..... 206/586
6,197,414 B1 * 3/2001 Kawai et al. ..... 428/297.4

* cited by examiner

*Primary Examiner*—Jim Foster
(74) *Attorney, Agent, or Firm*—Baniak Pine & Gannon

(57) ABSTRACT

A packaging component has a flat cushioning component constructed of corrugated material, such as of paper, consisting of a polygonal matrix mounted to a laminated fiberboard component. The packaging component provides superior resistance to the shear forces of heavy, cumbersome objects, provides cushioning and protection, is easily manufactured, cost-effective and is environmentally friendly.

15 Claims, 1 Drawing Sheet

PACKAGING PARTICULARLY USEFUL FOR HEAVY, CUMBERSOME OBJECTS

This application claims benefit of the provisional application, Ser. No. 60/125,863 under 35 U.S.C. 119(e), which provisional application was filed on Mar. 24, 1999.

FIELD OF THE INVENTION

The present invention generally relates to what is commonly referred to as "protective packaging", and more specifically to components utilized in protecting goods to be handled or shipped, and the materials utilized to fabricate such components.

BACKGROUND OF THE INVENTION

A packaging component may be defined as a material, or plurality of materials, selected and designed for the purpose of providing specific packaging properties or a range of properties. These materials would be used in such a manner as to construct or fabricate packaging components. Examples of packaging materials would be paper, corrugated paper, fiber board, polyurethane foam and boards, expanded polystyrene, polyethylene, polypropylene, steel, aluminum, wool, and the like. Virtually any other material deemed appropriate for the packaging challenge at hand could, of course, be employed.

A packaging component as an engineered device communicates with the object actually being packaged in such a manner as to preferably provide for the optimum level of packaging protection achievable. Examples of engineered packaging components would be a plastic bag, a corrugated carton, a wood or paper pallet, a corrugated slip sheet, an aluminum can, an expanded polystyrene corner, a "foam in place" construct made of polyurethane foam, and plastic bubble wrap, just to name a few. Obviously, the aforementioned list is far from comprehensive. More specifically, for the purposes of this disclosure, the terms "packaging", "protection", and "cushioning" are intended to refer to all of the processes and factors relevant to ensuring the safety of an item or items during the "material handling" process. Additionally, for the purposes of this disclosure, the term "material handling" is intended to refer to all of the processes and factors relevant to the staging, organization, storing, location, loading, movement, shipping, unloading, wrapping, containment, tracking, protection, and overall "safety and preservation" of goods and materials.

As illustrated above, a multitude of various packaging materials exists today. Even more staggering is the number of packaging components constructed of these materials. The principal criteria for determining the selection of materials and the subsequent design of the packaging component are usually performance and economy. Virtually any packaging challenge can be addressed effectively when only performance parameters are considered. However, when economic factors are taken into account, the task can become quite challenging.

One of the most formidable tasks in the field of packaging materials is to provide a packaging component which can successfully protect from damage the sharp edges of heavy cumbersome objects, such as porcelain sinks, bathtubs, toilets, etc. Existing packaging material and the components made therefrom for such heavy cumbersome objects are not entirely satisfactory in their mechanical performance, do not meet the requisite cost constraints, and simply do not provide an adequate performance-to-costs benefit.

For example, in the case of a porcelain bathtub, the bathtub itself is a cumbersome shape that is not easily packaged. Also, the bathtub's edges themselves, with their typical dimensions, add to the difficulty of packaging an already cumbersome shape. Furthermore, these edges (on units that are to be installed versus freestanding) tend to be sharp, may tend to cut through the packaging component and may subsequently damage other objects or the bathtub itself.

Currently, the protection of sharp edges on such heavy cumbersome objects, and the protection of heavy cumbersome objects themselves, is accomplished by utilizing a quantity of homogeneous materials sufficient to provide the desired level of performance. For example, numerous layers of corrugated fiberboard may commonly be used to provide a level of cushioning. However, in order to facilitate ease of package assembly, the layers of the corrugated fiberboard often need to be adhered together. This procedure requires additional material, weight, labor, while adding to the cost of the packaging component and overall package design.

Returning to the example of the bathtub, corrugated cardboard would be wrapped around the bathtub until the sharp edges were adequately protected. This would, in general, require large amounts of corrugated cardboard. Furthermore, standard corrugated cardboard is typically limited in its ability to cushion and conform to the cumbersome shape of the bathtub. The same might be true of the use of bubble wrap, for example, which has the added risk of being easily cut by the sharp edges.

Another solution currently utilized would be a custom-designed component fabricated from polyethylene foam, for instance. This tends to be a relatively expensive resolution to the problem in view of the cost of fabricating the component. Again, in the case of the bathtub, a polyethylene foam component could be custom-designed for the bathtub. It will be apparent to those skilled in the art that such a foam component might well be quite expensive to create.

It is most desirable to support or package an item within a container in such a manner as to position the main supporting members of the packaging component so that they communicate with as much surface area of the packaged item as possible. Stated differently, it is considered desirable to avoid placing main supporting members of the component in direct communication with load-carrying sharp edges, thus avoiding the possibility of the sharp edges of the item cutting through the main supporting members of the packaging. In numerous instances, the packaging professional, due to various constraints or circumstances, must place the main and/or secondary supports of the packaging component relative to the surface being supported in such a fashion as to cause the main supporting packaging material to come into direct contact with sharp, weight-carrying surfaces. This situation presents a special challenge to the packaging professional. To summarize, then, an efficient packaging component would advantageously provide a support mechanism that will hold the product steady, while also resisting the shear and other forces generated by the movement of any sharp edges of the packaged item. Additionally, the packaging component desirably should be environmentally friendly (e.g., biodegradable and recyclable), as well as being cost-effective.

Component designs of the prior art do not optimally address all of these requirements. Thus, packaging components for protecting the edges of heavy, cumbersome objects heretofore known suffer from a number of disadvantages.

SUMMARY OF THE INVENTION

Accordingly, it is an object of the present invention to provide an improved packaging component, and particularly one that will steadily hold and support a heavy, cumbersome object. It is another object of the present invention to provide a packaging component that will effectively resist the shear forces, as well as other forces, caused by sharp edges of a heavy, cumbersome object which come into contact with the packaging component.

Along with these and other ends, the packaging component of the present invention additionally provides a cost-effective and competitive solution to the problems of packaging a heavy, cumbersome object, particularly those with sharp edges. Furthermore, in its preferred form, the present invention meets the additional objective providing a packaging component that is biodegradable and/or recyclable. Moreover, the invention additionally provides a packaging component that can be manufactured easily and relatively inexpensively.

These and other ends are met in the present invention, which in one aspect comprises a packaging component having an elongated base material and a cushioning material affixed to the base material. The packaging component has been formed in one embodiment with the cushioning material beings cellular corrugated paper, and affixed to a substantially flat generally rigid fiberboard. In a preferred form, the fiberboard is formed into an L-shape having an inboard side defined by the interior angle of said L-shape and an outboard side, with the cellular corrugated material located on the outboard side of the fiberboard.

A system for packaging objects is also provided, by the invention, comprising a flat cushioning section, of material operatively attached to a fiberboard section, and a primary containment unit. A method is likewise provided comprising the steps of providing an object to be packaged, attaching a flat, cushioning section to a fiberboard section and conforming the flat, cushioning section to the object.

Other features, advantages and objects of the present invention will become more apparent from consideration of the accompanying drawings, the detailed description of a preferred embodiment related thereto, and the claims.

DETAILED DESCRIPTION OF A PRESENTLY PREFERRED EMBODIMENT

In accordance with the present invention, a component for packaging has been developed with particular application to the packaging of heavy cumbersome objects possessing sharp edges. While the invention will be described with respect to this one embodiment, it will be understood that the invention is not limited to just this exemplary embodiment and its specific application to the type of product being packaged.

Figure 1C:
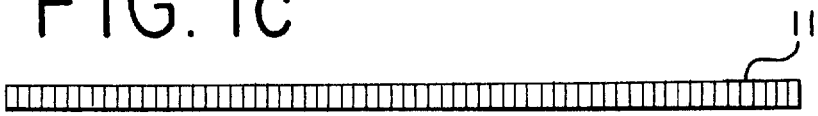
FIG. 1*c* is a side elevational view of one element making up the component of FIG. 1*a;*
Figure 1A:
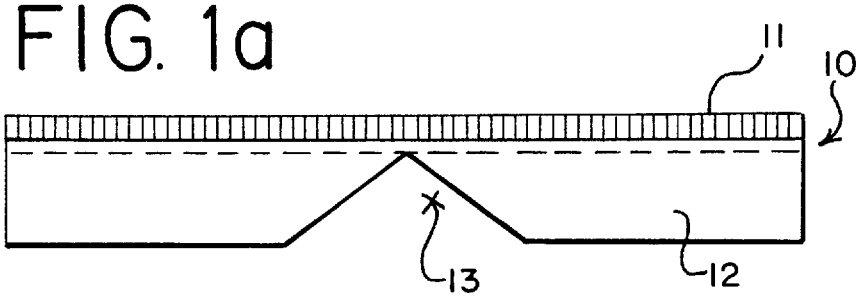
FIG. 1*a* is a side elevational view of a packaging component made in accordance with the invention.
Figure 1B:
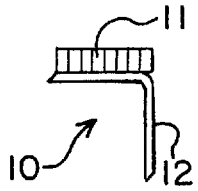
FIG. 1*b* is an end view of the component of FIG. 1*a;*
Figure 1D:
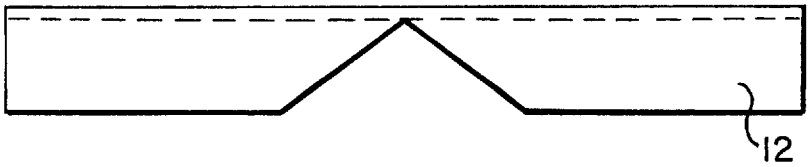
FIG. 1*d* is a side elevational view of the other element making up the component of FIG. 1*a*.

Turning initially to FIGS. 1*a* and 1*b*, an embodiment of the packaging component 10 of the present invention is depicted in FIG. 1*a* in side view and in FIG. 1*b* in end view. The packaging component 10 consists of one or more layers of Hexacomb® or analogous material 11 (FIG. 1*c*) affixed, via glue, adhesive, or the like, to at least one exterior surface of a segment of either flat or right-angled elongated laminated fiber board 12 (FIG. 1*d*). Hexacomb® and analogous materials can be described as a matrix of hexagonal polygons made of kraft paper, laminated between two sheets of kraft paper. Such a material is available from Hexacomb Corporation, 75 Tri-State, Lincolnshire, Ill. 60069. Honeycomb® is also such a material, and is available from Corrugated Systems, Inc., 14700 Harvard, Dolton, Ill. 60419. Flat or right angled laminated fiber board stock is available from Laminations, 2254 Harrison Street, Neenah, Wis. 54957-0469 as its trademarked name V-Board®.

Referring again to FIGS. 1*a* and 1*b*, it should be noted that the component 10 can be oriented in such a manner as to facilitate effective cushioning depending on the arrangement of the item to be packaged within the primary container. In this embodiment, one or more relieved areas 13 may be provided in the fiberboard to cut down on weight, and cost of material. Further, it is obvious that there are various possibilities with regard to the relative disposition of the elements 11, 12 depicted in FIGS. 1*c* and 1*d* with respect to one another. For example, one might choose to utilize Hexacomb® or analogous material 11 on both exterior surfaces of the laminated fiberboard 12. Yet another possibility would be to affix Honeycomb® to one interior (inboard) surface and one exterior (outboard) surface of the laminated fiberboard. Many other possible combinations exist.

Figure 2:
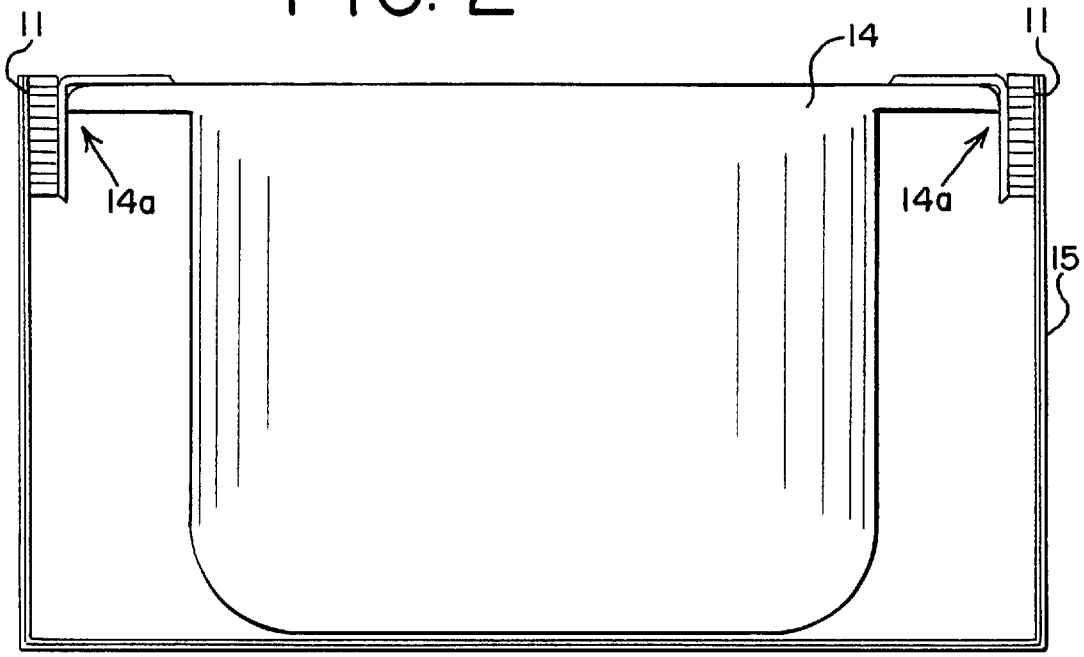
FIG. 2 is an elevational side view showing the packaging component of FIG. 1*a* in place and associated with a packaged item in a shipping carton, with one side of the carton removed for clarity.

FIG. 2 shows the embodiment of the present invention 10 configured in such an arrangement so as to protect the sharp, load-carrying edges of a large heavy object, in this case a porcelain sink 14, within the confines of a standard corrugated shipping carton 15. A major advantage of this invention is its ability to effectively buttress the large heavy object 14 within the corrugated shipping container 15 while simultaneously providing effective cushioning to the sharp edges 14*a*. It is immediately apparent that a multitude of possible arrangements exists. It is, in fact, an ancillary objective achieved by this invention that the packaging component described herein is extremely versatile in its range of cushioning/packaging applications.

Heterogeneous materials 11, 12 have been selected and utilized in order to exploit their respective physical and mechanical attributes. More precisely, components such as Hexacomb® and Honeycomb® provide important cushioning properties as well as positioning and support characteristics, while angled laminated fiber board provides a stiff, tough material that resists the shear forces of the heavy, sharp edge, and does not harm the fragile surface of the porcelain sink. Yet another objective achieved by this invention is that both components are biodegradable and recyclable.

From the above description, a number of advantages of the packaging component of the present invention become apparent:

- it provides a support mechanism that will hold the product steady;
- it effectively resists the shear forces caused by the sharp edges of the item;
- it provides a cost-effective and competitive packaging solution; and
- it is biodegradable and recyclable.

The manner of using the packaging component of the present invention is for the most part, identical to that for cushioning objects currently in use. Namely, one uses the component as a positioning, cushioning, and general utility protection device for packaged items or materials. In very general terms, it is utilized as a means of holding items in place while simultaneously protecting them as depicted in FIG. 2.

Accordingly, the reader will see that the packaging for heavy cumbersome objects of this invention can be used to provide requisite edge protection and cushioning characteristics, while at the same time providing mar resistance to the fine, delicate surfaces of heavy, cumbersome objects.

It also provides a packaging component that can be easily printed with environmentally friendly inks in order to carry messages or advertisements. It permits the engineering of "application specific" packaging component designs through enhanced material(s) selection.

As noted, the packaging component may use flat laminated fiberboard rather than the angled board depicted in the Figures. The packaging component 10 may be scored or cut in such a fashion as to facilitate folding or deliberate collapsing of the engineered component. Hexacomb® type material might be laminated to other additional materials such as corrugated paper or foam sheets in order to provide additional protection, and various weights of components may be used. Other modifications, choices of materials and applications will be understood by those of skill in the art, yet still will fall within the ambit of the invention. Thus, the scope of the invention should be determined by the appended claims and their legal equivalents, rather than by the examples given.

What is claimed is:

1. A lightweight packaging component comprising:

an elongated base having an inboard side and an outboard side, said elongated base being angled so as to born a first segment aligned generally perpendicular to a second segment; and a cushioning material affixed to said outboard side of said first segment of said elongated base, and said second segment of said elongated base forming an extending tab-shaped feature lacking cushioning material so as to lessen an overall weight of said cushioning material affixed to said elongated base to provide the lightweight packaging component, wherein said base is formed of a substantially flat generally rigid fiberboard material, wherein said fiberboard is formed into an L-shape such that said first segment is perpendicular to said second segment and a corner is defined by an interior angle of said L-shape and wherein said cellular corrugated material is located on opposing sides of said first segment.

2. A lightweight packaging component comprising:

an elongated base having an inboard side and an outboard side, said elongated base being angled so as to form a first segment aligned generally perpendicular to a second segment; and a cushioning material affixed to said outboard side of said first segment of said elongated base, and said second segment of said elongated base forming an extending tab-shaped feature lacking cushioning material, so as to lessen an overall weight of said cushioning material affixed to said elongated base to provide the lightweight packaging component and wherein said second segment of said elongated base material includes at least one relieved area formed therein.

3. The lightweight packaging component of claim 2 wherein said relieved area has a substantially triangular shape for permitting said lightweight packaging component to be shaped so as to contact at least two contiguous side edges of an associated object.

4. A packaging system for packaging a heavy object, wherein the heavy object includes a laterally extending object outer surface formed about a periphery thereof, comprising:

a shipping carton including a wall having an inner surface, wherein the object outer surface is positioned in said shipping carton adjacent said inside surface of said wall;

a lightweight packaging component including an elongated base having an inboard side and an outboard side, said elongated base being angled so as to form a first segment aligned generally perpendicular to a second segment; and a cushioning material affixed to said outboard side of said first segment of said elongated base material, said cushioning material being positioned adjacent said inner surface of said shipping carton wall and wherein said inboard side of said first segment is positioned adjacent said object outer surface, said second segment of said elongated base material lacking cushioning material and being positioned adjacent an upper side of said object, said upper side being adjacent said object outer surface.

5. The packaging system of claim 4 wherein a cushioning material is affixed to said inboard side of said first segment of said elongated base.

6. The packaging system of claim 4 wherein said elongated base is formed into an L-shape such that said first segment is perpendicular to said second segment and a corner is defined by an interior angle of said L-shape.

7. The packaging system of claim 4 wherein said inner surface of said shipping carton wall is at an upper end of said shipping carton.

8. The packaging system of claim 4 wherein said inner surface of said shipping carton wall is at a lower end of said shipping carton.

9. The packaging system of claim 4 wherein the heavy object is one of a tub and a sink.

10. A packaged object comprising:

a heavy object including a laterally extending object outer surface formed about a periphery thereof;

a shipping carton including a wall having an inner surface, wherein the object outer surface is positioned in said shipping carton adjacent said inside surface of said wall;

a lightweight packaging component including an elongated base having an inboard side and an outboard side, said elongated base being angled so as to form a first segment aligned generally perpendicular to a second segment; and a cushioning material affixed to said outboard side of said first segment of said elongated base material, said cushioning material being positioned adjacent said inner surface of said shipping carton wall and wherein said inboard side of said first segment is positioned adjacent said object outer surface, said second segment of said elongated base material lacking cushioning material and being positioned adjacent an upper side of said object, said upper side being adjacent said object outer surface.

11. The packaging system of claim 10 wherein a cushioning material is affix to said inboard side of said first segment of said elongated base.

12. The packaging system of claim 10 wherein said elongated base is formed into an L-shape such that said first segment is perpendicular to said second segment and a corner is defined by an interior angle of said L-shape.

13. The packaging system of claim 10 wherein said inner surface of shipping carton wall is an upper end of said shipping carton.

14. The packaging system of claim 10 wherein said inner surface of said shipping carton wall is at a lower end of said shipping carton.

15. The packaging system of claim 10 wherein the heavy object is one of a tub and a sink.

* * * * *